US005564399A

United States Patent [19]

Pedersen

[11] Patent Number: 5,564,399

[45] Date of Patent: Oct. 15, 1996

[54] CARBURETOR METERING SYSTEMS

[76] Inventor: John R. C. Pedersen, No. 3 Priors Road, Cheltenham, England, GL525AB

[21] Appl. No.: 307,639

[22] PCT Filed: Jan. 14, 1994

[86] PCT No.: PCT/GB94/00082

§ 371 Date: Feb. 21, 1995

§ 102(e) Date: Feb. 21, 1995

[87] PCT Pub. No.: WO94/16211

PCT Pub. Date: Jul. 21, 1994

[30] Foreign Application Priority Data

Jan. 16, 1993 [GB] United Kingdom ..... 9300819-1
Jul. 1, 1993 [GB] United Kingdom ..... 9313634-9

[51] Int. Cl.[6] ..... F02M 25/04

[52] U.S. Cl. ..... 123/524; 123/337; 48/189.6; 261/107

[58] Field of Search ..... 123/337, 403, 123/523, 524; 261/106, 107; 48/189.6

[56] References Cited

U.S. PATENT DOCUMENTS

| | | | |
|---|---|---|---|
| 2,109,878 | 3/1938 | Burrell . | |
| 4,234,527 | 11/1980 | Anderson | 261/102 |
| 4,290,401 | 9/1981 | Pedersen | 123/523 |
| 4,374,508 | 2/1983 | Pena | 123/524 |
| 4,397,286 | 8/1983 | Jackson et al. | 123/524 |
| 4,412,521 | 11/1983 | Silva | 123/523 |
| 4,550,706 | 11/1985 | Hoffman | 123/523 |
| 4,665,879 | 5/1987 | Earl | 123/523 |
| 4,881,507 | 11/1989 | San Filipo | 123/523 |
| 4,889,081 | 12/1989 | Ozaki . | |
| 5,207,207 | 5/1993 | Pederson | 123/586 |
| 5,384,074 | 1/1995 | Pederson | 261/107 |

FOREIGN PATENT DOCUMENTS

| | | | |
|---|---|---|---|
| 0078902 | 5/1983 | European Pat. Off. | 123/524 |
| 2-61404 | 3/1990 | Japan | 123/523 |
| 90554 | 9/1921 | Switzerland . | |
| 280242 | 5/1928 | United Kingdom . | |
| 319526 | 9/1929 | United Kingdom . | |

*Primary Examiner*—David A. Okonsky
*Attorney, Agent, or Firm*—John P. White; Peter J. Phillips

[57] ABSTRACT

A carburettor metering system comprises a fuel evaporator 113 consisting of porous parallel plates 114 with their lower portions immersed in fuel 121, fuel metering means 122 for supplying fuel to the evaporator 113, and a laminar flow air restrictor 128 comprising a series of parallel plates 127 separated by spacers and defining narrow gaps between the plates 127. Such an arrangement enables a substantially constant air/fuel mixture strength to be obtained over a wide range of air flow rates in single cylinder engines. Furthermore the supply of mixture to the engine by way of an exit tube 126 may be controlled by a valve member 132 coupled to the engine governor so that the rate of flow of mixture varies in dependence on the load, and additionally so as to change the system between two modes of carburettor operation, namely lean operation, which is provided up to about three quarters load, and rich operation in which additional fuel is supplied to the evaporator 113.

9 Claims, 4 Drawing Sheets

CARBURETOR METERING SYSTEMS

This invention relates to carburettor metering systems and is concerned more particularly, but not exclusively, with carburettor metering systems for supplying air/fuel mixture to small gasoline engines, whose exhaust emissions are subject to legislative control.

Small engines are typically single cylinder four-stroke engines of low cost, and are used in applications such as lawnmowers and outboard motors. Such single cylinder engines draw in air/fuel mixture intermittently, and this causes problems in fuel metering which are not present in multi-cylinder engines such as are typically used in the automotive field. Furthermore, small engines, unlike automotive engines, operate either at a governor controlled speed or with a fixed relationship between speed and load, and usually have fixed ignition timing. Existing carburettor metering systems for such small engines have a tendency to produce inhomogeneous air/fuel mixtures containing unevaporated fuel droplets which tend to increase the quantity of hydrocarbons in the exhaust emissions. It is also known that a homogeneous mixture allows operation with a weak air/fuel mixture, at part load, which has the advantage of reducing emissions of oxides of nitrogen and of carbon monoxide.

Generally carburettor metering systems produce a pressure difference related to air flow, and use this pressure difference to propel fuel from a constant pressure container into the air flow, usually as a more or less atomised spray. In order to produce an air/fuel mixture of highly uniform consistency, with the above mentioned benefits in terms of exhaust emissions, it is known to supply the fuel to a fabric wick through which the warmed air is passed to produce a substantially dry fuel vapour. In such systems, however, it is preferable that the power control throttle is placed downwind of the wick so that there are no significant pressure changes at the wick when the power demand changes such as might lead to large transient increases or decreases in mixture strength as the throttle is closed or opened.

Because of the position of the throttle in such systems, it is not possible to use a conventional venturi carburettor metering system which relies on the throttle plate to play a part in metering at low load. Furthermore the alternative of a constant depression, variable geometry carburettor metering system (typified by the well known S.U. carburettor) is complex and precluded in small engine applications on the ground of cost.

There is an optimum mixture strength for each load, which minimises exhaust emissions. For governed engines, or engines with a fixed relationship between speed and load, the mixture quantity varies in a known way with load, and can thus be used to control mixture strength. The optimum relationship is effected by engine design and must be determined by experiment. Current legislation in California specifies emission of carbon monoxide, and of combined hydrocarbons and oxides of nitrogen. In lean operation, with air/fuel ratios greater than about 17:1, the nitrogen oxide emissions fall as the mixture is made leaner, while, at very lean mixtures, hydrocarbon emissions start to rise. Carbon monoxide emissions are low and practically constant for ratios greater than about 16:1. The result is that the total emissions are low over a range of mixture strengths, which allows reasonable tolerance in approximating the optimum.

Legislation specifies limits based on tests at idle, quarter load, half load, three quarter load, and full load. For these conditions a typical engine might require air/fuel ratios of about 17:1 at idle, 18:1 at quarter load, 19:1 at half and three quarter loads, and 12:1 at full load. This latter rich mixture is to obtain full load while keeping total emissions as low as possible. The richer mixture at low load is needed, in part, because ignition timing is fixed.

The invention seeks to provide a novel carburettor metering system which is particularly suitable for such an application.

According to the present invention there is provided a carburettor metering system comprising evaporator means for absorbing liquid fuel for vaporisation into an air flow to produce an air/fuel mixture, fuel metering means for supplying fuel to the evaporator means, and air metering means for supplying air to the evaporator means to produce vaporisation of fuel supplied to the evaporator means, characterised in that the air metering means includes an air restrictor incorporating a plurality of narrow air passages arranged adjacent to one another so as to produce substantially laminar air flow in which the pressure difference across at least the major portion of the air restrictor is substantially linearly related to the flow rate of air through the air restrictor, the fuel metering means being arranged to supply fuel in dependence on said pressure difference.

Since it is relatively easy to meter fuel such that its flow rate is substantially linearly proportional to the pressure difference used to drive the fuel, the use of an air restrictor producing substantially laminar air flow allows a substantially constant air/fuel mixture strength to be obtained over a wide range of air flow rates regardless of pressure fluctuations such as are encountered in single cylinder engines.

Preferably the air restrictor comprises a series of parallel plates separated by spacers and defining narrow passages therebetween. Alternatively the air restrictor may comprise a plurality of small bore tubes arranged side-by-side. In either case the pressure difference across the restrictor is caused primarily by viscous effects and is related to air flow. The relationship is substantially linear provided that Reynolds' number, which increases with increasing flow rate and with plate spacing or tube diameter, is less than a critical value.

In order to keep Reynolds' number below its critical value for the air flow rates likely to be encountered in use, it is necessary for the restrictor to include a large number of passages. Cost and space restraints have the result that the throughflow cross-section for passage of air through the restrictor is reduced so that there is a further pressure drop due to the fact that the cross-section of the air flow increases on being discharged from the outlet of the restrictor. This further pressure drop varies with the square of the flow rate so that it introduces a non-linear contribution to the overall pressure difference. In some engines the mixture strength at the maximum lean range torque may need to be richer than that at lower loads. A small non-linear contribution to pressure difference can provide this necessary enrichment at higher flows. In other cases the existence of the non-linear contribution would be undesirable.

Accordingly, in accordance with a development of the invention, a venturi can be arranged upwind of the restrictor so as to provide a pressure drop at the throat of the venturi which substantially offsets the pressure drop at the outlet of the restrictor.

As is well known, a venturi provides a pressure drop at its throat proportional to the square of the flow followed by pressure recovery so that the outlet pressure of the venturi is substantially equal to the inlet pressure. Thus, if the pressure at the throat of the venturi is used as the reference pressure, the pressure at the outlet of the restrictor will differ from the reference pressure by a pressure difference which is substantially linearly related to the air flow rate, provided that the pressure drop at the throat of the venturi is chosen to match the pressure drop at the outlet of the restrictor, for any flow rate up to that corresponding to the critical Reynolds' number. The cross-section and length of the restrictor can then be chosen to provide a sufficient pressure difference for actuation of the required fuel flow whilst keeping the restrictor compact and minimising the restriction to air flow.

In a preferred embodiment the fuel metering means comprises a fuel restrictor in the form of a duct of relatively narrow cross-section through which fuel is conducted by the pressure difference across the air restrictor. For example a connection may be made between the inlet of the air restrictor and a point upstream of the fuel restrictor to maintain the fuel upstream of the fuel restrictor at the reference pressure of the inlet of the air restrictor, and a connection may be made between the outlet of the air restrictor and a point downstream of the fuel restrictor to maintain the fuel downstream of the fuel restrictor at the pressure of the outlet of the air restrictor. If the metering system includes a venturi, a connection may be made between the throat of the venturi and a point upstream of the fuel restrictor to maintain the fuel upstream of the fuel restrictor at the reference pressure of the venturi throat.

The invention also provides an evaporator for use in a carburettor metering system for vaporisation of fuel into an air flow passing through the evaporator, the evaporator comprising a series of parallel laminar elements spaced apart by spacers so as to define narrow air passages therebetween and providing porous evaporation surfaces along the sides of the passages, means for supplying fuel to the elements so that diffusion of fuel over the evaporation surfaces occurs by capillary action, and means for supplying air to the passages to permit fuel to be evaporated from the evaporation surfaces into the air as the air passes along the passages.

The laminar elements may be plates of rigid porous material, such as a sintered metal, or layers of fabric stretched over rigid supports with spacers therebetween.

The invention further provides a carburettor metering system comprising evaporator means for absorbing liquid fuel for vaporisation into an air flow, fuel metering means for supplying fuel to the evaporator means, and air metering means for supplying air to the evaporator means to produce vaporisation of fuel supplied to the evaporator means, wherein the fuel metering means incorporates a first fuel restrictor adapted to supply fuel from a source of fuel to the evaporator during both lean operation and rich operation of the system, a second fuel restrictor adapted to supply additional fuel from the source of fuel to the evaporator during rich operation of the system, and switching means for changing over from lean operation to rich operation by enabling supply of said additional fuel to the evaporator.

The switching means preferably comprises a vent valve which is openable to vent a line connecting the second fuel restrictor to the source of fuel in order to disable supply of said additional fuel to the evaporator and which is closable to enable supply of said additional fuel to the evaporator.

The invention further provides a control device for controlling the rate of flow of air/fuel mixture to an engine, the device comprising an outlet for supply of air/fuel mixture to the engine, a valve member movable relative to the outlet between relatively open and closed positions, and control means for moving the valve member relative to the-outlet in dependence on the load of the engine, whereby, as the engine load increases, the outlet is first progressively opened by the valve member, then at least partially closed and finally progressively opened again.

In order that the invention may be more fully understood, several carburettor metering systems in accordance with the invention will now be described, by way of example, with reference to the accompanying drawings, in which:

FIG. 1 is a block diagram of a first system;

FIG. 2 schematically shows a layout for such a system;

FIG. 3 schematically shows a section along the line A—A in FIG. 2;

FIGS. 4 and 5 respectively show a section through and a perspective view of a valve member of the system;

Figure 1:
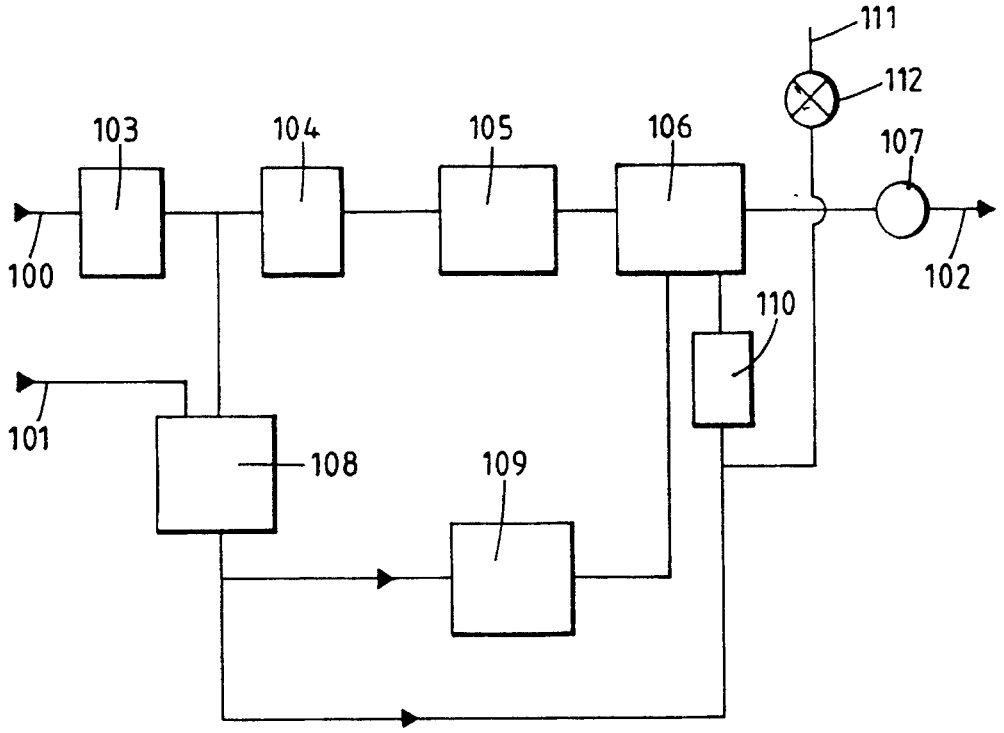

A first carburettor metering system in accordance with the invention will now be described with reference to FIG. 1 which shows a block diagram of the system. Air and fuel are inputted into the system by way of inlets 100 and 101 respectively, and the required air/fuel mixture is outputted by way of an outlet 102. The air enters the system through an air cleaner 103 and passes through a fixed pressure drop valve 104 and an air restrictor 105 to a fuel evaporator 106 before passing to the engine by way of a throttle 107. The components 104 and 105 can be interchanged if required.

The fuel is admitted to a constant pressure fuel reservoir 108 whose pressure datum is that of the air leaving the air cleaner 103. The reservoir 108 is typically a conventional float bowl. For lean operation fuel supplied from the reservoir 108 passes through a fuel restrictor 109, which is preferably simply a narrow tube, to the evaporator 106. For rich operation additional fuel is supplied from the reservoir 108 through a further fuel restrictor 110 of similar form into the air flow. The inlet to the fuel restrictor 110 is above the level at which fuel is permitted to flow from the reservoir 108, so that such additional fuel flow can be disabled by opening a vent valve 112 having an outlet 111 either to atmosphere or to the reference pressure at the outlet from the air cleaner 103. The opening of the vent valve 112 may be controlled by a cam on a governor shaft of the engine in dependence on the load of the engine.

Where the reservoir 108 is float-controlled, the level of fuel in the reservoir 108 should be below the level of the free fuel surface in the evaporator 106, in order to prevent fuel leakage when the engine is not running. Alternatively, where the reservoir 108 is diaphragm-controlled, the free surface of fuel in the evaporator must be higher than the point, set by the diaphragm offset spring, at which fuel would siphon from the reservoir. This imposes a need to provide a definite pressure, which is present only when the engine is running, before any fuel flows. Thus the pressure difference required to produce the necessary fuel flow must comprise a fixed component (the offset) plus a variable component which is most easily made linearly proportional to flow.

With respect to the air side of the system, an ideal arrangement would be to provide an air side pressure difference having a related fixed component plus a variable component proportional to the product of air flow and the required air/fuel ratio. In practice the variation in air/fuel ratio with load (and hence air flow) is met quite closely by providing an air side pressure difference having a fixed component somewhat greater than the fuel side offset, with a variable component which is substantially linearly related to the air flow but which has a small positive second order term (pressure drop component proportional to air flow squared). (If the air side fixed component were exactly equal to the fuel side offset, and there were no second order term, the air/fuel ratio would not vary with air flow.)

The second order term provides an air/fuel ratio which increases with air flow. The amount by which the air side fixed component exceeds the fuel side offset provides a fixed additional fuel flow at all air flows, and hence a greater air/fuel ratio at low flows. Thus, by changing the relative sizes of the fixed, linear and second order terms, a progressive variation in air/fuel ratio of any required magnitude can be produced. The total emissions are actually found to vary only slowly with air/fuel ratio near to the lean optimum value, so that some tolerance is available and the variation in air/fuel ratio provided by the mechanisms proposed can be maintained within the required tolerances.

The system described with reference to FIG. 10 has different components for the air side restrictor 105 and the evaporator 106. This is appropriate if the air resistance of the evaporator 106 varies substantially with the amount of fuel present, such as would be the case if the evaporator used woven fabric layers obturating the air flow. In this case the air passing between the strands of the fabric weave would be more or less restricted as the strands swelled or shrunk with varying fuel content. However, in another evaporator construction, the air passes through passages formed of material such that the air passage size is not substantially altered by varying fuel content, and in this case, under certain conditions, the two components 105 and 106 can be combined if required so that the evaporator itself imposes the required pressure difference.

A given evaporator at a given Reynolds' number has an efficiency which is defined as the ratio of the mixture strength at its outlet to the mixture strength at saturation under the given conditions of fuel temperature and air pressure. Thus an evaporator of lower efficiency must have an outlet temperature which is higher (and hence a higher saturation mixture strength) than is ideally needed. This higher temperature reduces the charge density and hence the power of the engine. At the evaporator outlet the mixture strength immediately adjacent to the fuel surface is just the saturation mixture strength of the fuel surface. However, in the air passages remote from the fuel surface, the mixture strength is determined by the amount of vapour which has diffused away from the fuel surface. Thus high efficiency requires that diffusion away from the fuel surface shall be substantially complete in the time taken for the air to pass from the inlet to the outlet. In practice this requires either very small air passages in a short structure, such as might be found in a finely woven fabric or in several layers of more coarsely woven fabric, or alternatively a number of long passages having spaced walls wetted by fuel. Finely woven fabric has little ability to spread fuel laterally by capillary action, and so is best suited for situations where fuel is supplied finely atomised. On the other hand relatively long passages can be provided between plates of rigid porous material, such as a sintered metal or ceramic, or between layers of fabric stretched over appropriate rigid supports with suitable spacers therebetween. Alternatively the passages can be in the form of small holes in a thick block of porous material.

Figure 2:
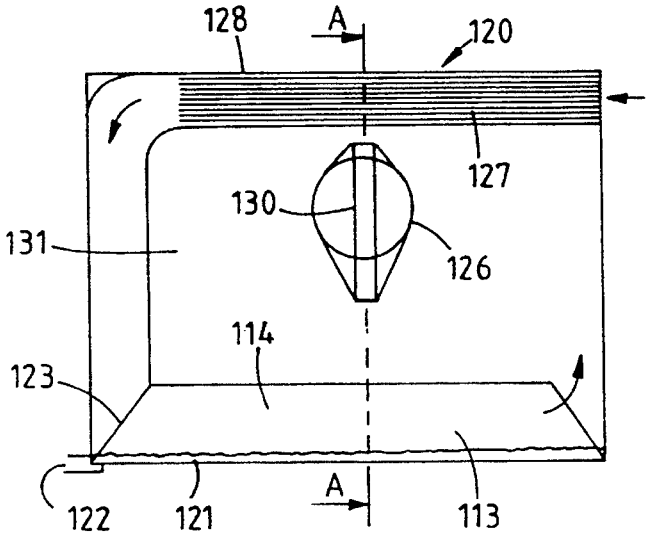
Figure 3:
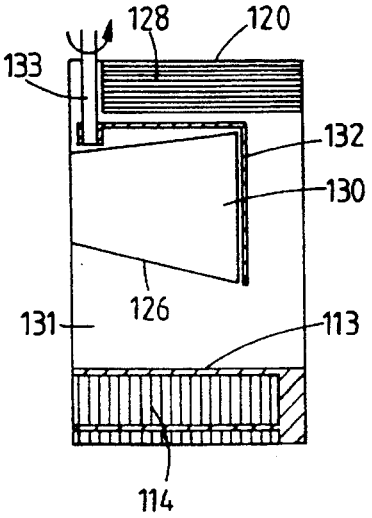

FIG. 2 shows a layout arrangement for such a system in which the fuel evaporator 113 is disposed in the lower part of a housing 120 so that lower portions of plates 114 of the evaporator 113 are immersed within fuel 121 supplied to the bottom of the housing 120 by way of a fuel inlets 122 (corresponding to the inlets from the fuel restrictors 109 and 110 in FIG. 1). Air is supplied to the inlet 123 of the evaporator 113 by way of a laminar flow air restrictor 128 comprising a series of parallel plates 127 separated by spacers (not shown) and defining narrow gaps between the plates 127, and the air/fuel mixture outputted from the evaporator 113 is supplied to the engine by way of an exit tube 126.

If required, a fixed pressure drop valve (not shown) may be provided intermediate the air restrictor 128 and the evaporator 113, which is kept closed either by a weight or a light spring. In the latter case the pressure drop will not remain absolutely fixed but will vary to a certain extent with flow, thus providing a further means of adjusting the relationship between the air/fuel ratio and the flow. The requirement is that the valve opens when the pressure difference between its inlet and outlet exceeds a predetermined level, and thereafter opens progressively with increasing flow to maintain the required pressure drop.

The exit tube 126 comprises a slotted inlet 130 opening into the space 131 within the housing 120 with which the output of the evaporator 113 communicates, and is shaped so as to have a circular outlet, of the same cross-sectional area as the slotted inlet 130, which communicates with the engine. A valve member 132 (not shown in FIG. 2) is disposed adjacent the inlet 130 and is coupled to a shaft 133 which is capable of being rotated through a limited angle by the engine governor (not shown).

Figure 4:
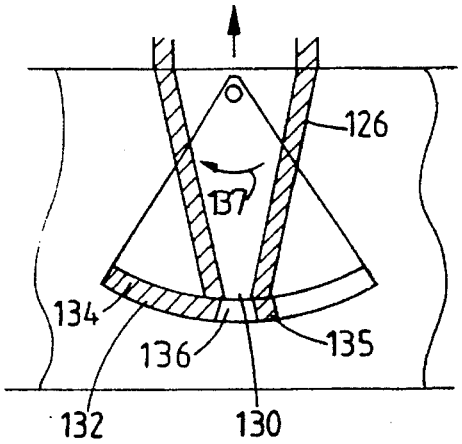

The valve member 132, the construction and function of which will be described in more detail with reference to FIGS. 4, 5 and 6, serves to change the system between two modes of carburettor operation, namely lean operation, which is provided up to about three quarters load, and in which fuel is supplied solely by way of the restrictor 109, and rich operation in which additional fuel is supplied by way of the restrictor 110. In lean operation the throttle 107 is progressively opened by the governor up to full throttle as the load is increased. Thereafter, as the load is further increased, changeover to rich operation takes place, and the throttle 107 is closed as additional fuel is introduced in order to prevent a stepwise increase in torque. Further increase in load leads to progressive opening of the throttle 107 again, up to full throttle.

Figure 5:
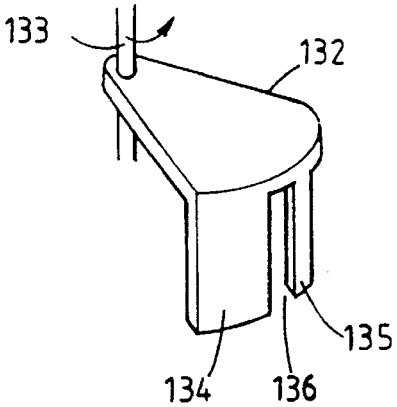
Figure 6:
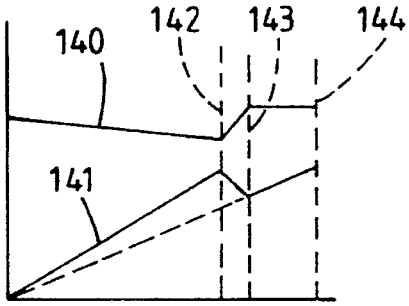
FIG. 6 is an explanatory diagram.

Referring to FIGS. 5 and 6 it will be seen that the valve member 132 has first and second shutters 134 and 135 separated by a slot 136, the shutters 134 and 135 and the slot 136 cooperating with the inlet 130 of the exit tube 126 to control the rate at which air/fuel mixture is supplied to the engine in dependence on the load on the engine. As the load is increased the valve member 132 is rotated in the direction of the arrow 137. Furthermore, the angular position of the valve member 132 also determines whether extra fuel is added to the mixture by way of the fuel restrictor 110 by closing of the vent valve 112 (see FIG. 1). Initially, at low load, the vent valve 112 is open so that no extra fuel is added to the mixture and the air/fuel ratio varies with load as shown in the initial part of the plot 140 of this ratio against load as shown in FIG. 6. Furthermore the shutter 134 of the valve member 132 is in such a position that it partially covers the inlet 130 to restrict the flow of mixture to the engine. As the load is increased the valve member 132 is rotated in the direction of the arrow 137 so that the shutter 134 uncovers the inlet 130 with the result that the open area of the inlet 130 increases progressively with the load, as shown in the initial part of the plot 141 of inlet area against load as shown in FIG. 6.

When substantially the whole of the inlet 130 is uncovered by the shutter 134, which occurs at just above three quarters load, changeover from lean operation to rich operation is effected by closing of the vent valve 112 so that additional fuel is supplied to the evaporator 113 by way of the fuel restrictor 110. This transition point is indicated in FIG. 6 by the broken line 142, and it will be appreciated that the air/fuel ratio increases progressively beyond this point, as shown by the plot 140, due to the addition of extra fuel. At the same time the shutter 135 of the valve member 132 starts to move across the inlet 130, thus reducing the open area of the inlet 130 until a maximum area of the inlet 130 is covered by the shutter 135. A further transition point is then reached, as shown by the broken line 143 in FIG. 6, beyond which the inlet 130 is progressively uncovered by the shutter 135, and extra fuel is still supplied to the evaporator 113 by way of the fuel restrictor 110. The open area of the inlet 130 then increases back to a maximum at full load, as indicated by the broken line 144 in FIG. 6. This arrangement ensures that the developed torque varies progressively as the valve member 132 is rotated in the direction of the arrow 137 in dependence on the load of the engine.

Figure 7:
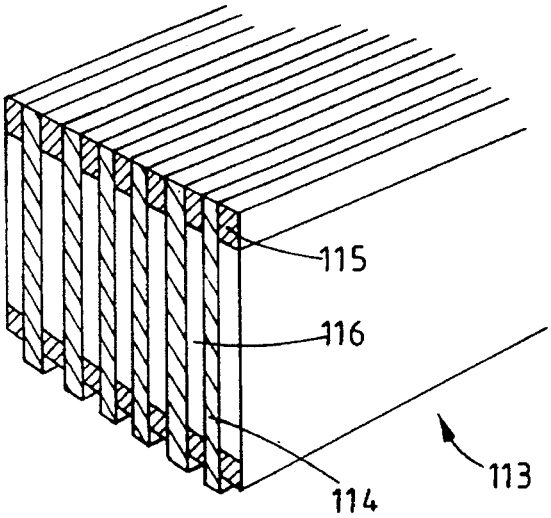
FIGS. 7 and 8 show parts of two evaporators usable in such a system.

FIG. 7 shows the evaporator 113 which consists of a stack of vertical plates 114 of rigid porous material, such as sintered metal, adjacent plates 114 being separated by upper and lower spacers 115 so as to define air passages 116 therebetween. The upper spacers 115 are flush with the tops of the plates 114, whereas the lower spacers 115 are spaced from the bottoms of the plates 114 so as to leave short lower portions of the plates 114 which may be immersed in the fuel. The plates 114 are packed into a container so that the air is constrained to pass between the plates 114 and along the length of the passages 116 defined by the plates 114 and the spacers 115. The fuel supplied to the lower portions of the plates 114 migrates upwardly by capillary action so as to provide a large surface area of fuel for evaporation into the air passing along the passages 116. In order to simplify the manufacturing process, each plate 114 may be formed integrally with its associated spacers 115.

Figure 8:
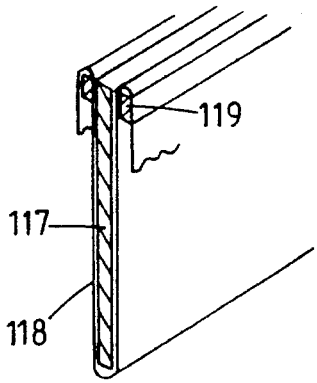

FIG. 8 shows a variant of the above described evaporator 113 in which, instead of the plates 114, a stack of solid plates 117 wrapped with fabric 118 is provided, the plates 117 being separated by spacers 119 and the fabric 118 being in the form of a single sheet which is wrapped around the spacers 119 in between wrapping of successive plates 117.

In the evaporator arrangements described above it is important that the evaporation rate of fuel should as far as possible vary linearly with the air flow rate over a wide range of air flow rates, so that, for a given mixture strength, the plate wetness should not change appreciably with a change in the air flow. Variation in plate wetness can only be achieved by variation in the quantity of fuel resident in the plates of the evaporator, and changes in the quantity of resident fuel are undesirable because they produce transient changes in the required fuel supply rate or transient excursions in mixture strength. Generally the arrangement should be such that Renolds' number is kept above a critical value for the required range of flow rates, and various compensating mechanisms may be applied towards this end.

For single-cylinder engines it is preferred that the evaporator is such that the volume of air in the evaporator is at all times comparable to or greater than the maximum volume demand per cycle of the engine. If required the effect of an intermittent air flow may be compensated for by designing the evaporator such that the air transit time within the evaporator is large with respect to the cycle time, that is so that the total volume represented by the product of the plate area and the gap between the plates is large compared with the maximum ingested volume of air per cycle, so as to give the longest possible time for fuel vapour to diffuse into the air stream.

For multi-cylinder engines, on the other hand, the air flow through the evaporator is more nearly continuous. In this case it is necessary to ensure that the evaporator is designed such that the Renolds' number is above the critical value for the average minimum air flow through the evaporator. However, for a fixed geometry, the pressure drop imposed by the evaporator varies in proportion to the square of the air flow, with the result that this pressure drop would become very large at the maximum air flow if the design of the apparatus is optimised for the lowest air flow through the evaporator. In order to avoid such a large pressure drop at maximum flow, various compensating mechanisms may be applied. For example an adjustable compensating plate may be provided which serves to progressively uncover the gaps between the evaporator plates, in either a linear or a stepwise manner, so that an increasing number of passages become available for the air flow through the evaporator as the air flow rate increases, thus maintaining Renolds' number within the required range. If such a compensating mechanism is provided, it is not essential that the volume of air in the evaporator is maintained comparable to or greater than the maximum volume demand per cycle of the engine.

Figure 9:
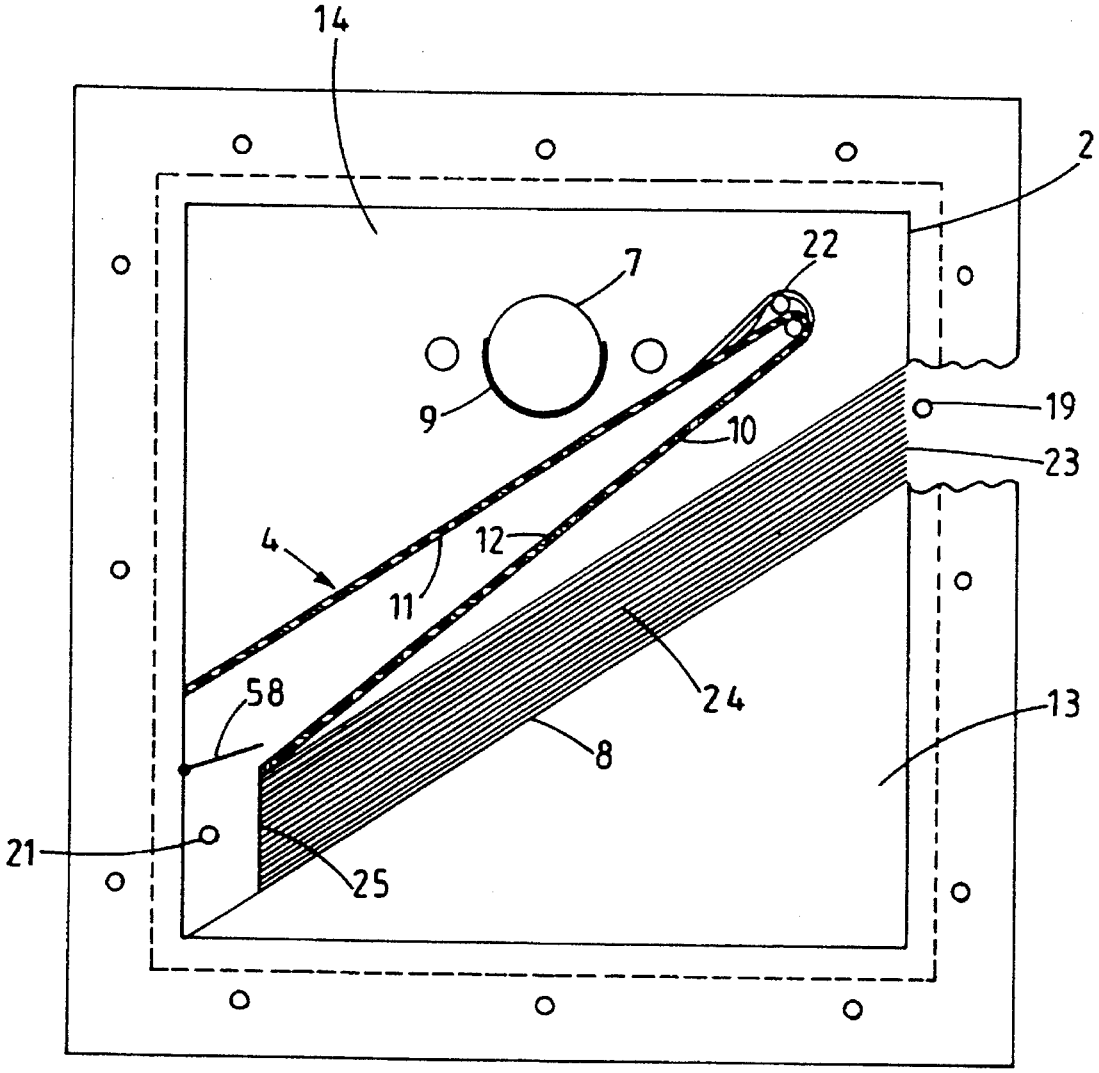
FIG. 9 is a schematic section through a wick and an air metering part of a second system.

Referring to FIG. 9, a second carburettor metering system in accordance with the invention includes, within a common housing 2, a wick 4 and a laminar flow air restrictor 8. The air restrictor 8 divides the housing 2 into a wick chamber 14 and a lower chamber 13. The housing 2 is provided with an exit tube 7 leading to the engine via the throttle (not shown). The exit tube 7 is provided with a half round baffle 9 for preventing droplets of fuel from entering the engine. The wick 4 comprises a wire metal support grid 10 having two inclined flat portions 11 and 12 arranged to form a V-shaped cross-section, and extending between opposite side walls of the wick chamber 14.

Figure 10:
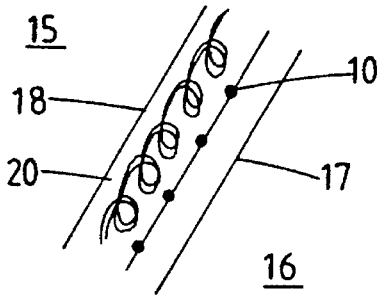
FIG. 10 is a schematic section showing the wick in greater detail.

The construction of the wick is shown in greater detail in FIG. 10. The upwind and downwind sides 15 and 16 of the support grid 10 are each covered by a layer 17 or 18 of relatively tightly woven fabric which is of sufficiently fine mesh to prevent droplets of liquid fuel passing therethrough. This tightly woven fabric is particularly efficient at evaporating the fuel. Furthermore a layer 20 of relatively loosely woven fabric is applied to the upwind face only of the support grid 10, between the support grid 10 and the layer 18 of tightly woven material, to absorb liquid fuel supplied to the wick from a spreader tube 22 (see FIG. 9) and to permit lateral spread of the fuel by capillary action over the whole of the layer 20 so as to maximise the surface area of fuel available for evaporation into the air flow passing through the wick 4.

The spreader tube 22, which extends along the top of the wick 4 and is embedded within the layer 20 of loosely woven fabric, is formed with small holes along its length, through which fuel is supplied to the wick 4. In order to provide accurate control of the air/fuel mixture strength and to avoid fluctuations in mixture strength over the engine cycle, fuel is supplied to the wick 4 by the spreader tube 22 in dependence on the pressure difference between first and second pressure openings 19 and 21 located respectively near the inlet 23 of the air restrictor 8 and near the outlet 25 of the air restrictor 8. Since the air restrictor 8 comprises a series of parallel plates 24 separated by spacers (not shown) and defining narrow gaps between the plates 24, the air flow through the air restrictor 8 produces a pressure difference between the ends of the air restrictor 8 that is substantially linearly related to the air flow rate through the restrictor 8 (provided that the air restrictor 8 is sufficiently large).

Figure 11:
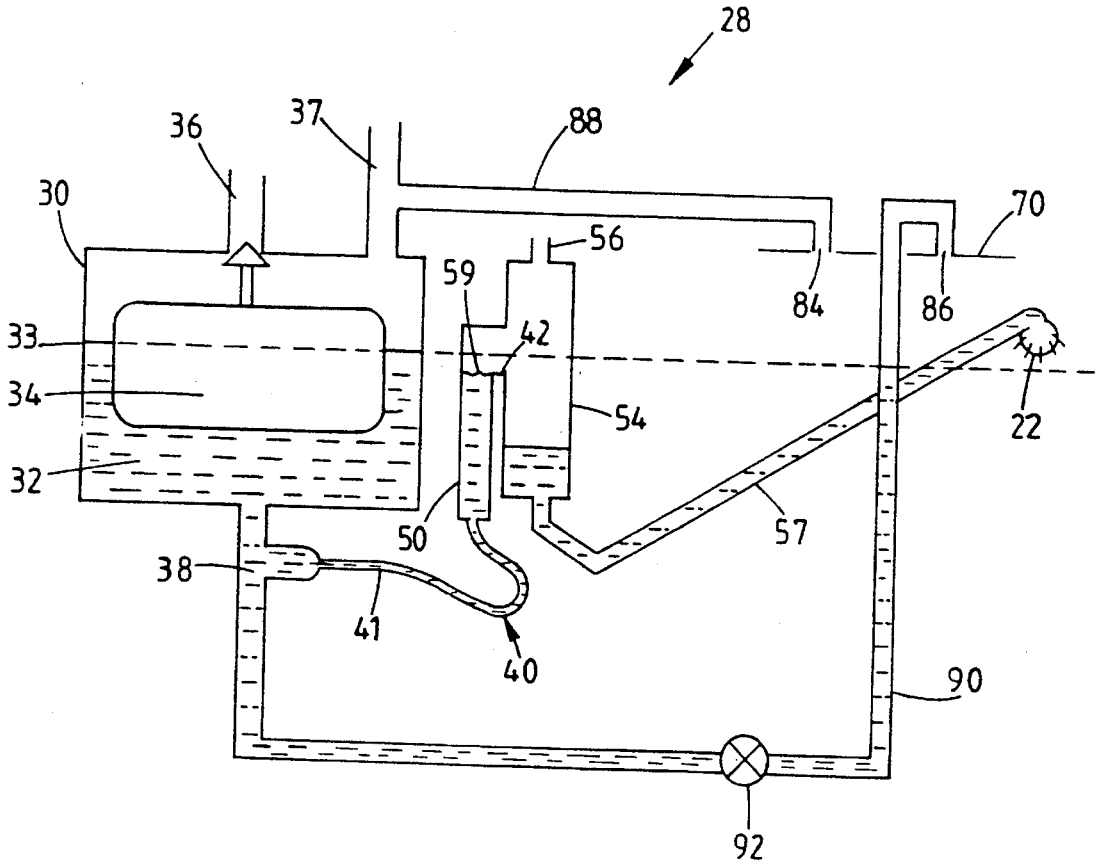
FIG. 11 is a diagrammatic section through a fuel metering part of the second system.

Referring to FIG. 11 the fuel metering part 28 of the system, which is housed within the lower chamber 3, comprises a fuel reservoir 30 containing fuel 32 up to a level 33 determined by a float 34 within the reservoir 30. The reservoir 30 has a fuel inlet 36 and is vented by a pressure tube 37 connected to the first pressure opening 19 so as to apply the pressure at the first pressure opening 19 to the fuel 32 in the reservoir 30. The reservoir 30 is connected by a duct 38 to a fuel restrictor 40 comprising a length of small bore tubing 41, and the fuel outputted from the fuel restrictor 40 emerges into a well 50.

The well 50 is in turn connected to a further well 54 so that fuel is supplied to the well 54 by spilling over a weir 42 from the well 50. The weir 42 defines the height of the fuel at the outlet from the restrictor 40 relative to the float level 33. The wells 50 and 54 are both vented by a pressure tube 56 which is connected to the second pressure opening 21 so as to apply the pressure at the second pressure opening 21 to the fuel in the well 50 thus providing a pressure difference between the pressure tubes 37 and 56 which is linearly proportional to the air flow rate for controlling fuel flow through the fuel restrictor 40. Fuel 32 is supplied from the well 54 to the spreader tube 22 in the wick chamber 14 by way of a fuel supply duct 57. In order to apply the necessary pressure drop to permit fuel to be conducted along the duct 57, the air flow is conducted from the outlet 25 of the air restrictor 8 through a hinged weighted flap 58 (see FIG. 9) prior to being introduced into the wick chamber 14. The well 50 provides a free surface 59 of fuel beneath the level 33 of fuel 32 in the reservoir 30 and thus prevents any irregularities of fuel supply to the spreader tube 22 due to surface tension effects.

The described fuel restrictor 40 provides accurate control of fuel metering since the fuel flow rate through the fuel restrictor 40 is linearly related to the pressure difference between the first and second pressure openings 19 and 21 which is itself linearly related to the air flow rate. However, in addition to the pressure difference between the two ends of the air restrictor 8, there is a further pressure drop, corresponding to the difference between the pressure at the outlet 25 of the air restrictor 8 and the pressure at the pressure opening 21, and magnitude of this pressure drop varies with the square of the flow rate. Strictly this pressure drop occurs on entry into the air restrictor 8 due to the decrease in throughflow cross-section caused by the presence of the plates 24, although the pressure drop only becomes apparent on discharge of the air from the spaces between the plates 24 at the outlet 25 as the pressure drop is not recovered at the outlet 25. This square law pressure drop becomes more significant as the air restrictor 8 is made smaller, such as might be the case, for example, in a chainsaw motor.

If it is necessary to compensate for this square law pressure drop at the outlet 25 of the restrictor 8, the heated air flow supplied to the restrictor 8 may, before entering the restrictor 8, be first passed through a venturi (not shown) which produces a pressure drop at the throat of the venturi whose magnitude again varies with the square of the flow rate. Downwind of the venturi throat the pressure recovers so that the pressure at the inlet 23 of the restrictor 8 is substantially the same as the pressure at the inlet of the venturi. The pressure tube 37 may then be connected to the venturi throat so that the pressure at the venturi throat is taken as the reference pressure and the square law pressure drop at the venturi throat is arranged to compensate for the square law pressure drop at the outlet 25 of the air restrictor 8. It will be appreciated that the pressure difference between the pressure tubes 37 and 56 will then be substantially linearly related to the air flow rate for flow rates having a Renolds' number which is less than a critical value.

The exit tube 7 is preferable provided with a valve member (not shown) for changing the system from lean operation to rich operation in a similar manner to that already described with reference to the previous embodiment. As shown in FIG. 11 a flange 70 which extends around the exit tube 7 is provided with a vent aperture 84 and a fuel enrichment aperture 86. The vent aperture 84 is connected via a vent conduit 88 to the pressure tube 37, and the fuel enrichment aperture 86 is connected via a fuel conduit 90 to the duct 38. The angular position of the valve member, which is controlled in dependence on the engine load, determines the rate at which mixture is supplied to the engine and also determines whether extra fuel is added to the mixture by way of a fuel conduit 90 incorporating a fuel restrictor 92 connected to the fuel enrichment aperture 86, in a similar manner to that already described with reference to the previous embodiment.

Such a carburettor metering system is particularly advantageous for use with single cylinder four-stroke engines of low cost, such as are used in lawnmowers for example, and permits accurate control of air/fuel mixture strength in spite of the intermittent nature of supply of mixture to such an engine. However, the system may also be used with multi-cylinder engines. The use of a throttle downstream of the carburettor metering system minimises mixture strength excursions during transients, as are obtained, for example, on increase or decrease of engine load.

I claim:

1. A carburettor metering system comprising evaporator means for absorbing liquid fuel for vaporisation into an air flow to produce an air/fuel mixture, fuel metering means for supplying fuel to the evaporator means, and air metering means for supplying air to the evaporator means, characterised in that the air metering means includes an air restrictor incorporating a plurality of narrow air passages arranged adjacent to one another so as to produce substantially laminar air flow in which the pressure difference across at least the major portion of the air restrictor is substantially linearly related to the flow rate of air through the air restrictor, the fuel metering means being arranged to supply fuel in dependence on said pressure difference.

2. A system according to claim 1, wherein the air passages of the air restrictor are straight passages arranged parallel to one another.

3. A system according to claim 2, wherein the air restrictor comprises a series of parallel plates separated by spacers and defining said air passages therebetween.

4. A system according to claim 1, wherein a portion of the air restrictor introduces a small pressure drop which varies with the flow rate of air through the air restrictor so as to provide an air/fuel mixture of increased strength at high air flow rates.

5. A system according to claim 1, wherein valve means are provided in series with the air restrictor for applying a substantially fixed pressure drop to the air flow.

6. A system according to claim 1, wherein the fuel metering means comprises a fuel restrictor through which fuel is conducted by the pressure difference across the air restrictor.

7. A system according to claim 1, wherein enrichment means are provided for adding additional fuel to the air/fuel mixture when the load exceeds a predetermined level.

8. An evaporator for use in a carburettor metering system for vaporisation of fuel into an air flow passing through the evaporator, characterised in that the evaporator comprises a series of parallel laminar elements spaced apart by spacers so as to define narrow air passages therebetween and providing porous evaporation surface along the sides of the passages, means for supplying fuel to the elements so that diffusion of fuel over the evaporation surfaces occurs by capillary action, and means for supplying air to the air passages to permit fuel to be evaporated from the evaporation surfaces into the air passing along the air passages.

9. A carburettor metering system comprising evaporator means for absorbing liquid fuel for vaporisation into an air flow, fuel metering means for supplying fuel to the evaporator means, and air metering means for supplying air to the evaporator means to produce vaporisation of fuel supplied to the evaporator means, wherein the fuel metering means incorporates a first fuel restrictor adapted to supply fuel from a source of fuel to the evaporator means during both lean operation and rich operation of the system, a second fuel restrictor adapted to supply additional fuel from the source of fuel to the evaporator means during rich operation of the system, and switching means for changing over from lean operation to rich operation by enabling supply of said additional fuel to the evaporator.

* * * * *